US005536280A

United States Patent [19]

DeRosa et al.

[11] Patent Number: 5,536,280

[45] Date of Patent: Jul. 16, 1996

[54] NON-METALLIC ANTI-KNOCK FUEL ADDITIVE

[75] Inventors: Thomas F. DeRosa, Passaic, N.J.; William M. Studzinski, Beacon, N.Y.; Joseph M. Russo, Poughkeepsie, N.Y.; Benjamin J. Kaufman, Hopewell Junction, N.Y.; Robert T. Hahn, Beacon, N.Y.

[73] Assignee: Texaco Inc., White Plains, N.Y.

[21] Appl. No.: 347,664

[22] Filed: Dec. 1, 1994

[51] Int. Cl.[6] ..... C10L 1/22

[52] U.S. Cl. ..... 44/426; 44/431

[58] Field of Search ..... 44/426, 429, 431

[56] References Cited

U.S. PATENT DOCUMENTS

| | | | |
|---|---|---|---|
| 2,230,844 | 2/1941 | Miller | 44/426 |
| 2,662,815 | 12/1953 | Rudel | 44/426 |

OTHER PUBLICATIONS

Patent Application D#79,998, Ser. No. 08/308,890 DeRosa et al.

Patent Application #79,997, Ser. No. 08/332,685 DeRosa, et al.

*Primary Examiner*—Prince Willis, Jr.
*Assistant Examiner*—Cephia D. Toomer
*Attorney, Agent, or Firm*—Kenneth R. Priem; Richard A. Morgan

[57] ABSTRACT

A gasoline fuel composition comprising a major portion of gasoline and a minor portion of a diphenylamine, effective to increase the octane number of the gasoline composition, represented by the formula:

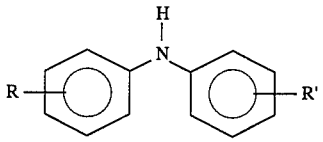

where R and R' are independently hydrogen or $C_9$ aliphatic hydrocarbons.

2 Claims, No Drawings

NON-METALLIC ANTI-KNOCK FUEL ADDITIVE

BACKGROUND OF THE INVENTION

1. Field of the Invention

The present invention relates to a gasoline with improved octane number. More specifically, the present invention relates to a non-metallic anti-knock fuel additive. 2. Description of Related Information Spark initiated internal combustion gasoline engines require fuel of a minimum octane level which depends upon the design of the engine. If such an engine is operated on a gasoline which has an octane number lower than the minimum requirement for the engine, "knocking" will occur. Generally, "knocking" occurs when a fuel, especially gasoline, spontaneously and prematurely ignites or detonates in an engine prior to spark plug initiated ignition. It may be further characterized as a non-homogeneous production of free radicals that ultimately interfere with a flame wave front. Gasolines can be refined to have sufficiently high octane numbers to run today's high compression engines, but such refining is expensive and energy intensive. To increase the octane level at decreased cost, a number of metallic fuel additives have been developed which, when added to gasoline, increase its octane rating and therefore are effective in controlling engine knock. Although the exact mechanism is unknown, the-effectiveness of these metallic agents is believed to entail deactivation of free radical intermediates generated during combustion. The problem with metallic anti-knock gasoline fuel additives, however, is the high toxicity of their combustion products. For example, the thermal decomposition of polyalkyl plumbates, most notably tetramethyl- and tetraethyl lead, are lead and lead oxides. All of these metallic octane improvers have been banned nationwide, because their oxidation products produce metallic lead and a variety of lead oxide salts. Lead and lead oxides are potent neurotoxins and, in the gaseous form of an automotive exhaust, become highly neuro-active.

It would therefore be desirable to identify non-metallic anti-knock agents which would produce little toxic combustion products compared to metallic anti-knock agents, and which would provide a needed increase in octane ratings to eliminate "knocking".

SUMMARY OF THE INVENTION

In accordance with certain of its aspects, the present invention provides a gasoline composition comprising a major portion of a mixture of hydrocarbons boiling in the gasoline boiling range and a minor portion, effective to increase the octane number of the gasoline composition, of a diphenylamine represented by the formula:

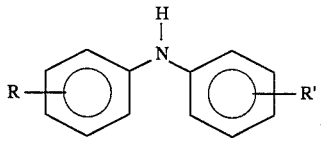

where R and R' independently comprise hydrogen or a $C_9$ aliphatic hydrocarbon.

In a second embodiment, the present invention provides a method of improving the octane number of a gasoline which comprises adding to a major portion of a mixture of hydrocarbons boiling in the gasoline boiling range, a minor, octane improving portion of the diphenylamine described above.

DETAILED DESCRIPTION OF THE INVENTION

We have found that the anti-knock gasoline fuel additive of the present invention provides significant increases in octane number for gasoline compositions.

The anti-knock gasoline fuel additive of the present invention comprises a diphenylamine represented by the formula:

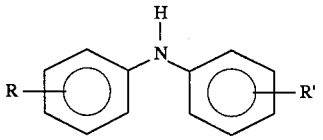

where R and R' independently comprise hydrogen or a $C_9$ aliphatic hydrocarbon. Preferably, R and R' are para- with respect to the nitrogen atom.

The synthesis of the nonyl substituted diphenylamine is routine. The following are illustrative:

1) condensing alkyl aniline using an iron catalyst according to the equation:

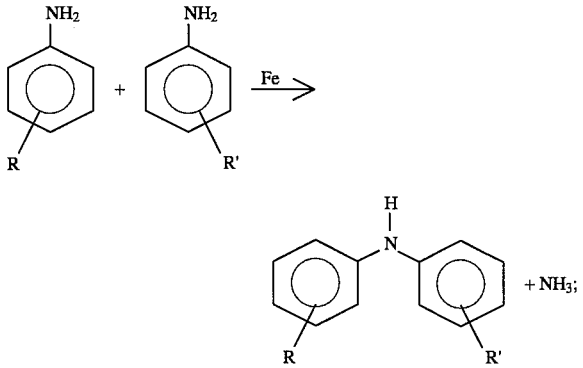

2) reduction of bis-acyl diphenyl amines according to the equation:

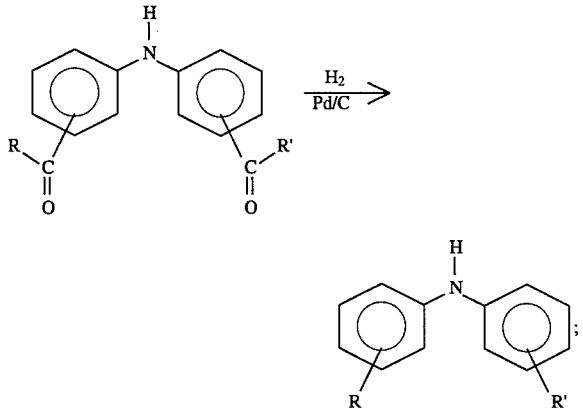

3) direct addition of R and R' to diphenyl amine according to the equation:

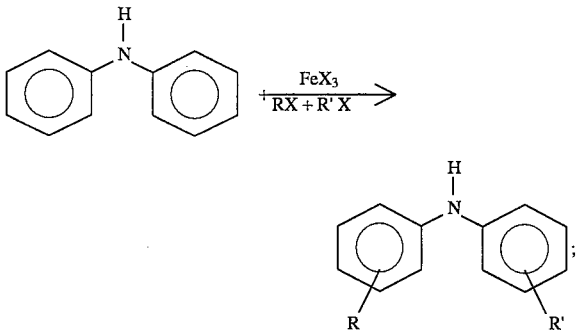

and the like, where at least one of R and R' comprises a $C_9$ aliphatic hydrocarbon.

The anti-knock agent of the present invention is typically employed in a minor octane increasing amount. It may be added in an amount between 0.01 wt. % and 50 wt. %, preferably between 0.01 wt. % and 5 wt. % and more preferably between about 0.5 wt. % and about 2.0 wt. %. The additive can be blended into the gasoline by any method, because dialkyl diphenylamines show favorable solubility in hydrocarbon solvents.

The gasolines which can be treated by the process of this invention to raise their octane number boil in the range between about 50° F. and about 450° F., and may be straight run gasolines, but more preferably they will be blended gasolines which are available commercially. An example of a typical gasoline useful in the practice of the present invention is provided in Table I.

TABLE I

| Typical Gasoline | |
|---|---|
| IBP | 80.7° F. |
| 5% | 111.9° F. |
| 10% | 124.5° F. |
| 20% | 141.4° F. |
| 30% | 159.4° F. |
| 40% | 182.3° F. |
| 50% | 207.6° F. |
| 60% | 230.9° F. |
| 70% | 251.2° F. |
| 80% | 277.5° F. |
| 90% | 320.3° F. |
| 95% | 347.1° F. |
| FBP | 417.2° F. |
| RECOVERY | 99.2 vol. % |
| LOSS | 0.1 vol. % |
| RESIDUE | 0.7 vol. % |

These commercial gasolines typically contain components derived from catalytic cracking, reforming, isomerization, etc. Although the octane number of any gasoline may be improved by the technique of this invention, it is preferred to treat charge gasolines of nominal octane number between 75–95. The gasolines may contain other common additives for the improvement of detergency, emissions, dispersancy, corrosion resistance, anti-haze, etc.

It is a feature of the gasoline compositions of the present invention that they exhibit increased motor octane number (MON) and research octane number (RON). The experimental engine parameters that distinguish MON from RON are summarized in Table II.

TABLE II

| RON v. MON Experimental Conditions | | |
|---|---|---|
| | RON Light Duty; Original CFR | MON Heavy Duty; New CFR |
| Engine speed, rpm | 600 | 900 |
| Intake air temperature, °F. | 125 | 100 |
| Mixture temperature, °F. | not controlled | 300 |
| Spark advance | for maximum power (later 13°) | automatic* |

*Changes automatically with compression ratio; basic setting is 26° before top center at 5:1 compression ratio.

The additives of the present invention were tested for their ability to increase the RON and MON of a six component standard gasoline blend, shown in Table III.

TABLE III

| Experimental Gasoline Blend | |
|---|---|
| Compound | Amount (wt. %) |
| isopentane | 30 |
| n-heptane | 10 |
| i-octane | 5 |
| n-dodecane | 7 |
| toluene | 25 |
| i-butylbenzene | 10 |

EXAMPLE I

In Example I, 2.0 wt % of diphenylamine (R and R'=hydrogen) was added to the experimental gasoline composition described above. Three samples of the base fuel and the base fuel plus additive were tested for research octane number response, using test method ASTM D2700. The results are presented in Table IV. Likewise, three samples of the base fuel and base fuel plus the additive were tested for motor octane number response, using test method ASTM D2699. The results are presented in Table V.

TABLE IV

| Test Number | Experimental Base Fuel RON | Experimental Base Fuel Plus Diphenylamine Mixture RON |
|---|---|---|
| 1 | 80.0 | 85.5 |
| 2 | 79.7 | 84.3 |
| 3 | 81.4 | 86.0 |
| Average | 80.4 | 85.3 |

TABLE V

| Test Number | Experimental Base Fuel MON | Experimental Base Fuel Plus Diphenylamine Mixture MON |
|---|---|---|
| 1 | 76.2 | 80.6 |
| 2 | 76.5 | 80.0 |
| 3 | 75.9 | 80.0 |
| Average | 76.2 | 80.2 |

Thus, at a concentration of 2.0 wt %, diphenylamine provides a significant average RON increase of 4.9 units and a significant MON increase of 4.0 units. It provides this octane increase without recourse to metallic anti-knock additive agents.

EXAMPLE II

In Example II, 2.0 wt % of di-nonyl diphenylamine was added to the experimental gasoline composition described above. Five samples of the base fuel and the base fuel plus additive were tested for research octane number response, using test method ASTM D2700. The results are presented in Table VI. Likewise, five samples of the base fuel and base fuel plus the additive were tested for motor octane number response, using test method ASTM D2699. The results are presented in Table VII.

TABLE VI

| Test Number | Experimental Base Fuel RON | Experimental Base Fuel Plus di-nonyl diphenylamine RON |
|---|---|---|
| 1 | 81.5 | 83.2 |
| 2 | 81.8 | 83.7 |
| 3 | 81.6 | 83.7 |
| 4 | 81.8 | 83.5 |
| 5 | 82.0 | 83.1 |
| Average | 81.7 | 83.4 |

TABLE VII

| Test Number | Experimental Base Fuel MON | Experimental Base Fuel Plus di-nonyl diphenylamine MON |
|---|---|---|
| 1 | 72.7 | 73.2 |
| 2 | 73.1 | 75.6 |
| 3 | 73.3 | 75.4 |
| 4 | 73.5 | 75.5 |
| 5 | 73.3 | 74.9 |
| Average | 73.2 | 74.9 |

Thus, at a concentration of 2.0 wt %, the additive provides a significant average RON increase of 1.7 units and a significant MON increase of 1.7 units.

We claim:

1. A lead free gasoline composition comprising a major portion of gasoline and about 0.5 to 2 wt % dialkyl diphenylamines, effective to increase the octane number of the gasoline composition represented by the formula:

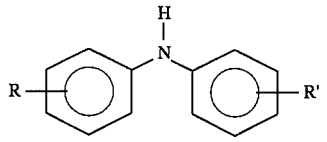

where R and R' are $C_9$ aliphatic hydrocarbons.

2. A method of improving the octane number of a lead free gasoline which comprises adding to a major portion of gasoline, about 0.5 to 2 wt % dialkyl diphenylamines, represented by the formula:

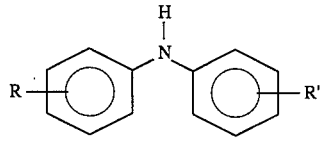

where R and R' are $C_9$ aliphatic hydrocarbons.

* * * * *